United States Patent [19]

Krob

[11] 4,386,788

[45] Jun. 7, 1983

[54] SKI BRAKE

[75] Inventor: Erwin Krob, Vienna, Austria

[73] Assignee: TMC Corporation, Baar, Switzerland

[21] Appl. No.: 234,226

[22] Filed: Feb. 13, 1981

[30] Foreign Application Priority Data

Feb. 15, 1980 [AT] Austria ..... 824/80

[51] Int. Cl.[3] ..... A63C 7/10

[52] U.S. Cl. ..... 280/605; 188/5

[58] Field of Search ..... 280/605, 604, 12 AB; 188/5, 8

[56] References Cited

U.S. PATENT DOCUMENTS 4,234,206 11/1980 Hofbauer et al. ..... 280/605
4,272,099 6/1981 Svoboda et al. ..... 280/605
4,294,459 10/1981 Svoboda et al. ..... 280/605

FOREIGN PATENT DOCUMENTS 2714175 10/1977 Fed. Rep. of Germany ..... 280/605
3038018 5/1981 Fed. Rep. of Germany ..... 280/605

*Primary Examiner*—Joseph F. Peters, Jr.
*Assistant Examiner*—Mitchell J. Hill
*Attorney, Agent, or Firm*—Flynn, Thiel, Boutell & Tanis

[57] ABSTRACT

A ski brake has an operating pedal pivotally connected to a wire braking bar with two braking mandrels. The pedal is pivotal about a first ski fixed axle and the bar is pivotal about a second axle which is parallel to the first axle and supported for movement relative to the pedal in directions substantially parallel to the longitudinally axis of the ski. An upwardly projecting path extender which is disposed in the path of movement of the second axle raises the second axle and the braking mandrels to positions spaced above the surface of the ski, and then lowers the second axle to a position adjacent the surface of the ski as the ski brake moves between its retracted and braking positions. A mechanism is provided for pulling the braking mandrels laterally inwardly as the ski brake approaches the retracted position.

13 Claims, 8 Drawing Figures

SKI BRAKE

FIELD OF THE INVENTION

The invention relates to a ski brake having an operating pedal and having a braking bar which has two braking wings or braking mandrels and consists of a wire material having a plurality of bends and, more particularly, relates to such a ski brake in which the braking pedal and braking bar can be pivoted against the force of a spring about an axle which is secured on the upper side of a ski and the braking bar can be pivoted about a further axle which extends substantially parallel to the first-mentioned axle and, viewed in the direction of the longitudinal axis of the ski, is supported for relative to the ski-fixed axle in a holding part.

BACKGROUND OF THE INVENTION

An exemplary ski brake of the foregoing type is described in German Offenlegungsschrift No. 27 58 658. In this conventional construction, it is possible to achieve advantageous transmission ratios for the operation of the braking bar, and this ski brake is also suited for use with to various ski-binding types, but there is the disadvantage that the braking mandrels or braking wings, in the retracted position of the ski brake, lie at all times next to the side surfaces of the ski and can be caught on obstacles such as tree roots and stones which project from the ground.

Ski brakes which, in the retracted position, have mandrels which lie above the upper surface and more or less inwardly of the two side surfaces of the ski have also belonged for several years to the state of the art. For example, reference is made to the ski brake embodiment in German Offenlegungsschrift No. 24 12 623 in which a pressure bar is associated with a stepping bar which also has the braking mandrels and, during a stepping down on the stepping bar, the two braking mandrels are swung inwardly toward the longitudinal axis of the ski. A disadvantage of this embodiment is that both the braking effect, which requires a relatively strong braking bar, and also the elasticity must be provided by one and the same structural part, namely the stepping-bar, which consists of a piece of wire material. These contrasting requirements lead automatically to a compromising solution.

In all these types of ski brakes, it is common that the braking bar is initially swung into a position in which the braking mandrels lie with certainty above the plane of the upper side of the ski, and the pulling in of the two braking mandrels or braking wings is then achieved only in this position, it being of no importance in what manner the pulling in is done. These solutions, however, have the disadvantage that the dimensions selected to carry out such movement are limited to a relatively small space in the practical design of ski brakes, so that either the extent of the pulling in is not sufficient or the designer finds himself forced to accept degradation in the dimensioning. Through this, the dimensions of the ski brakes are increased, which situation in turn is a disadvantage during use, due to a more difficult stepping in.

This is where the present invention comes in, having as an object the provision of an improved ski brake of the above-mentioned type in which the braking wings or mandrels can be moved with better effect into their retracted position.

SUMMARY OF THE INVENTION

This object is inventively achieved by building into the range of movement of the braking wings or mandrels a path extender which is effective in an elevational direction and is constructed in the form of a hump, bulge or the like.

Through this measure, a holding arm section of the braking wing or mandrel is lifted during a phase of the stepping down on the braking mechanism of the ski brake so that the free end of the braking wing or mandrel passes through a point located farther above the upper side of the ski than is the case in the earlier solutions. In the last phase of the stepping down, which phase corresponds with the final stepped-down condition of the braking mechanism, the holding arm section of the braking wing or mandrel leaves the path extender so that the ski brake lies substantially in the same elevational position above the upper side of the ski as is the case in the conventional devices. The main advantage of this embodiment, which can easily be recognized, is that the designer achieves lower structural heights in the entire ski brake construction, while the pulling-in effect is simultaneously improved.

In an advantageous embodiment of the invention, the path extender is a guideway which is provided in a ski-fixed holding part and has first a straight section, then a rising section, and finally a falling section. The precision of the guideway for the braking bar and thus of the braking mechanism is determined by the width of the holding part.

In a further development of this inventive thought, the rising and falling sections of the guideway are constructed to extend along approximately a sine curve, and the rising section is connected to the straight section through a rounded portion. This construction has proven to be particularly advantageous.

In a different advantageous embodiment of the invention, the movable axle of the braking bar is pivotally supported by two bearings which are each provided in a respective bearing plate. Each bearing plate has two slots therein, one extending rectilinearly and the other being bent. The slots slidably receive upright bolts which are fixed against movement relative to the ski. The path extender is a humplike formation which is preferably constructed of the material of the base plate. In this manner, it is possible on the one hand to adjust the degree of the pulling in of the braking mandrels or wings to be particularly advantageous and on the other hand to design the path extender in a particularly simple manner.

In a further development of this inventive thought, the erecting force for the braking mechanism is provided by a pair of springs which each act onto a respective bearing plate and urge such bearing plate into a position in which the braking mechanism is in the braking position. The total spring force can be adjusted through this measure to meet varying requirements.

In order to achieve a pulling-in effect which is as great as possible, it is further inventively provided that the bent guide slot has a rectilinearly extending section which passes over through a bend into a second section which defines an acute angle with the longitudinal axis of the ski. The associated bolt is disposed at the bend of the guide slot, the holding arm section of the braking bar or of the braking mandrel rests on the rising section of the path extender, the length of the angled section of the guide slot being at least as long as or longer than the distance which the holding arm of the braking bar or of the braking mandrel covers as it moves across the path extender. In this manner, the braking wing or mandrel is in a position above the upper side of the ski when the pulling in starts and is in the pulled-in position when, due to the stepping down on the braking mechanism, the final retracted position is reached.

According to a still further characteristic of the invention, each of the holding parts for the braking wings is constructed as a kind of a frame which includes the path extender. This embodiment has a particularly simple design.

As is known, the operation of ski brakes is disadvantageously influenced by friction forces which are created between individual sliding structural parts. To bring help here, it is provided according to the invention that the path extender, and preferably its holding part, is a structural part separate from the base plate which is fixedly connected to the base plate and consists of a material, preferably plastic, which has a low frictional resistance. Alternatively, the portion of the surface of the path extender or its holding part or frame which the holding arm section of the braking wing or mandrel slides along is provided with a plastic coating having good sliding characteristics.

A further inventive measure also aims in this direction. It provides that at least the portions of the holding arm sections of the braking wings or mandrels which slide along the path extenders consist of a plastic material having good sliding characteristics or, alternatively, are coated with such a material, applied for example in a conventional manner in the form of stampings.

Even though the tension produced in the braking bar can effect swinging of the braking mechanism from the retracted position to the braking position, it can be advantageous when the erecting is done by a separate spring. It is for this purpose provided that the spring which serves to swing the braking mechanism from the ready position into the braking position is a leg or torsion spring arranged on the ski-fixed swivel axis of the operating pedal, which torsion spring provides at least a portion of the force which is necessary for swinging up the braking mechanism and would otherwise be provided solely by the tension produced in the braking bar by the pulling in of the braking wings or braking mandrels.

A different thought of the invention lies in the ski-fixed holding part being a plate, the longitudinal axis of which forms an acute angle with the longitudinal axis of the ski. In this manner, the degree of the pulling in and return of the two braking wings or mandrels can occur to a desired degree.

A still further inventive thought consists in the path extender being a saddle surface, the center line of which defines with the plane which extends at a right angle to the longitudinal axis of the ski and is positioned vertically on the upper side of the ski, viewed in the horizontal and/or vertical plane, an acute angle, preferably an acute solid angle. Through this measure, it is also possible to advantageously control the pulling in and out of the braking wings or mandrels.

BRIEF DESCRIPTION OF THE DRAWINGS

Further characteristics, advantages and details of the invention will be described in greater detail hereinafter in connection with the drawings, which illustrate several exemplary embodiments:

FIGS. 3 and 4 illustrate a second another exemplary embodiment of the ski brake, wherein FIG. 3 is a side view in the braking position and FIG. 4 is a top view of half of the ski brake of FIG. 3 in the retracted position and with the operating pedal omitted for clarity;

Figure 5:
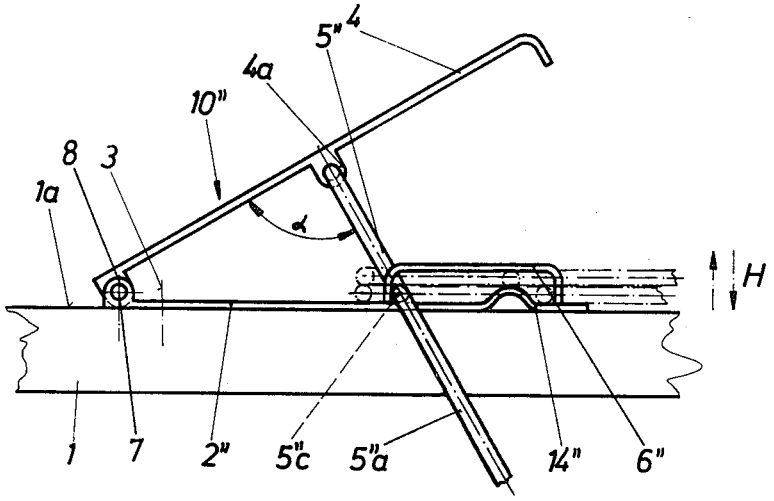
FIG. 5 illustrates a further exemplary embodiment of the ski brake in the braking position.

Structural parts which are of identical construction are identified throughout the exemplary embodiments with the same reference numerals, while structural parts which are somewhat different but serve similar purposes are identified with the same reference numerals and differentiated with one or two primes (').

DETAILED DESCRIPTION

Figure 1:
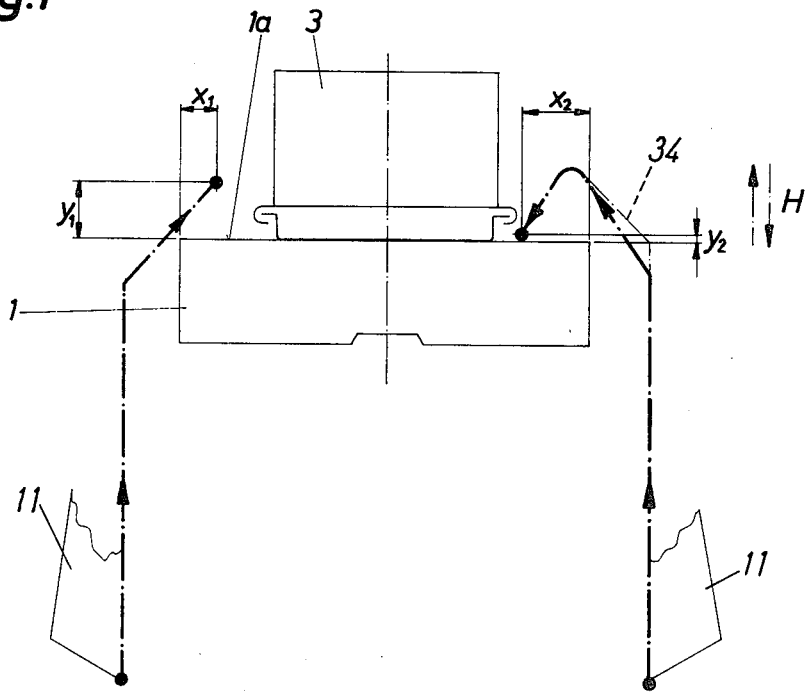
FIG. 1 is a schematic view taken in the direction of the longitudinal axis of a ski and illustrated the sequence of movement of a conventional pulling-in operation in the left half thereof and an inventive pulling-in operation in the right half thereof.

FIG. 1 illustrates a ski 1 having a ski binding 3 mounted in a conventional manner on the upper side 1*a* thereof and indicated only in outline. The left half of FIG. 1 shows the end area of a braking bar which is not illustrated in detail and is identified generally as a braking mandrel 11. A heavy dash-dotted line indicates the path of movement of the tip of the braking mandrel 11 when this braking mechanism is moved in the usual manner into the retracted position, during which a lateral pulling in occurs. It can be recognized that, in order to maximize the lateral pulling in $x_1$, the braking mandrel 11 must arrive at a height $y_1$ above the upper side 1*a* of the ski 1. It can also be recognized that the elevational distance $y_1$ of the tip of the braking mandrel 11 above the ski surface is greater than the lateral distance $x_1$ of the tip from the side surface of the ski 1.

The heavy dash-dotted line in the right half of FIG. 1 illustrates a path of movement in which the braking mandrel 11 is first lifted by a not-illustrated path extender using the inventive teaching to a greater height than is the case in conventional ski brakes of this type and is subsequently lowered toward the upper side 1*a* of the ski 1 as the pulling in continues. Thus, the lateral distance $x_2$ is substantially larger than in the conventional construction but the final elevational position $y_2$ is substantially less. A catching of the braking mandrels 11 is thus excluded with certainty, since the path extender, both during the swinging of the braking mechanism from the braking position into the retracted position and also in the reversed sequence, lifts the braking wing or mandrel to the pregiven height above the upper side 1*a* of the ski 1, so that the swinging in and out can be carried out without any danger of getting caught.

In the case of the ski brakes shown in the three embodiments according to FIGS. 2 to 5 and identified with respective reference numerals 10, 10' or 10'', a braking mechanism which consists substantially of an operating pedal 4 and of a braking bar 5, 5' or 5'' is mounted on the upper side 1*a* of the ski by means of a base plate 2, 2' or 2''. The operating pedal 4 is pivotally supported on the base plate 2, 2' or 2'' by means of an axle 7 which is supported in axial bearings 8 and is fixed with respect to the base plate 2, 2' or 2''. The operating pedal 4 has a bearing point part 4*a* for effecting a pivotal support of the braking bar 5, 5' or 5''.

The position of the bearing part 4*a* is chosen so that the operating pedal 4 can be operated without any danger of self-locking. It is for this reason that the angle $\alpha$ of the triangle formed by the base plate 2, 2', 2'', the operating pedal 4, and the braking bar 5, 5', 5'', which angle lies between the operating pedal 4 and the braking bar 5, 5' or 5'', is an obtuse angle. The preferred size of such angle, in the braking position of the ski brake, is approximately 100°.

Fastening of the inventive ski brake 10, 10', 10'' on the upper side 1*a* of the ski 1 can be done either by screws or, in connection with a ski binding, by means of a ski-fixed guide rail through which the ski brake can be adjusted independently or with the ski binding to different sizes of ski shoes. Both such fastening methods are known and are therefore not discussed here in great detail. The illustrated ski brakes 10, 10' or 10'' are preferably secured by means of schematically indicated screws 3 to the upper side 1*a* of the ski 1.

The design of the braking bar 5, 5', 5'' is substantially identical in all exemplary embodiments and only the manner in which it is supported differs significantly. For this reason alone, the individual embodiments of the braking bar were identified with respective reference numerals 5, 5' and 5''. Since the design itself can best be understood from the second exemplary embodiment, the braking bar 5' will first be discussed in detail.

Figure 4:
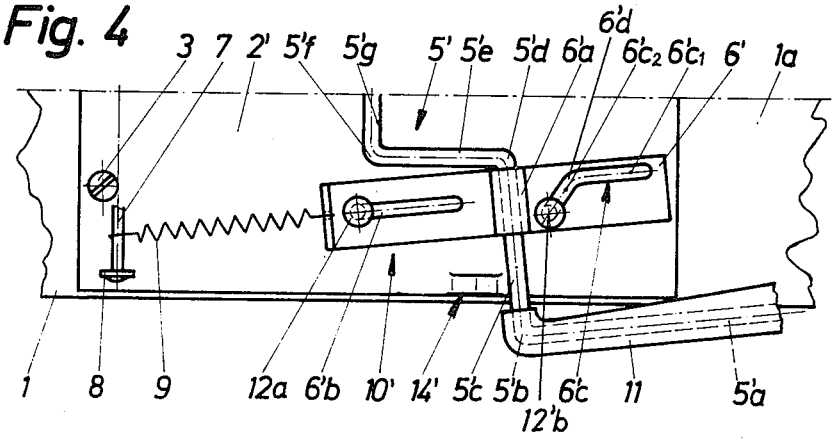

The braking bar 5' consists of a wire material with a plurality of bends. FIG. 4 illustrates only half of the braking bar 5', but the other half, in relation to the longitudinal axis of the ski, is symmetric to the illustrated half. Starting from the free end of the braking bar 5', a first section 5'*a* can be recognized which transfers through a first bend 5'*b* into a second straight section 5'*c* called a holding arm section. The first section 5'*a* and the second section 5'*c* form with respect to each other an angle of approximately 90°. The second section 5'*c* transfers through a second bend 5'*d* into a third section 5'*e* which extends substantially parallel to the first section 5'*a* but which, with reference to the third section 5'*c*, points in the opposite direction from the section 5'*a*. Starting from the third section 5'*e*, there extends from a third bend 5'*f*, again a right angle, a fourth section 5'*g* to which the other half of the braking bar 5' is connected. If the braking bar 5' is constructed in one piece, the two fourth sections 5'*g* of the two halves of the braking bar 5' are a common section of the bar 5'. It is also possible, however, to manufacture the braking bar as two equal parts and to connect these together in the area of the fourth section 5'*g* so that that they are fixed against rotation with respect to one another. For example, they can be screwed together or can be pressed into a sleeve, and the sleeve can additionally have a lock to prevent rotation which includes a groove-spring connection. In any case, the fourth section 5'*g* serves as an axle for the braking bar 5' and is pivotally supported in the bearing part 4*a* of the operating pedal 4. The third section 5'*c* of the braking bar 5' serves as the movable axle and is guidedly supported for movement in the direction of the longitudinal axis of the ski 1 in a manner which will yet be described in detail. The first section 5'*a* of the braking bar 5' carries in a conventional manner a braking wing 11 which is fixed in a conventional manner against rotation on the first section 5'*a*. The free end of the braking wing 11 is preferably constructed as a braking mandrel in order to assure a better hold on icy slopes, but it is also possible for the first section 5'*a* of the braking bar 5' itself to be constructed as a braking mandrel.

The control arrangement which forms the actual subject matter of the invention and which effects the swivelling of the first sections 5'*a* and the braking wings 11 toward the longitudinal axis of the ski 1 will now be discussed. For a better understanding, the following description initially describes in detail the design of the control mechanism of the second exemplary embodiment, according to FIGS. 3 and 4.

As one can recognize particularly well from FIG. 4, the third section 5'*c* of the braking bar 5', which serves as the movable axle, lies in a bearing portion 6'*a* of a bearing plate 6' which is guidedly held on the ski 1 by means of two holding bolts 12*a* and 12*b* which are conventionally secured in the base plate 2'. To guide each bearing plate 6' on the two holding bolts 12, two slots 6'*b* and 6'*c* are provided therein. The slot 6'*b* lies closer to the swivel axle 7 of the operating pedal 4 and extends rectilinearly, while the slot 6'*c* has a bent shape. A first section $6'c_1$ of the slot 6'*c* is remote from the bearing 6'*a* and extends approximately parallel to the longitudinal axis of the bearing plate 6'. The section $6'c_1$ is connected through a bend 6'*d* to a second section $6'c_2$ of the slot 6'*c* which extends at an angle of approximately 55° with respect to the longitudinal axis of the bearing plate 6'. Through this construction of the slot 6'*c*, which slot serves as a control path or guide slot, a strong swivelling of the free ends of the braking wings 11, or of the section 5'*a* of the braking bar 5' when constructed as a braking mandrel, is assured. The bearing plate 6' is biased by a tension spring 9, one end of which engages a flange on the bearing plate 6' and the other end of which is suspended on the swivel axle 7 of the operating pedal 4. The tension spring 9 urges the bearing plate 6' and the braking bar 5' toward the braking position and will thereafter hold same in this position.

If a force which is indicated by the arrow P (FIG. 3) acts downwardly onto the operating pedal 4, then the force of the tension spring 9 is overcome through the braking bar 5' and the bearing plate 6' is moved to the position shown in FIG. 4. It is easily understood that, when the braking bar 5' is constructed symmetrically, two bearing plates 6' and accordingly two tension springs 9 are provided, whereby the braking bar 5' is pivotally supported by means of its two sections 5'*c* in the bearings 6'*a* of the two bearing plates 6'. Since the two bearing plates 6' are reciprocally movable relative to the swivel axle 7 of the operating pedal 4 in the direction of the longitudinal axis of the ski 1 and since the two bearings 6'*a* together with the two second sections 5'*c* of the braking bar 5' are also moved, the two sections 5'*c* of the braking bar 5' are to be viewed as a kind of movable axle for the braking bar 5'.

In order to achieve a better pulling-in effect for the ends of the braking wings 11, or the sections 5'*a* of the braking bar 5' when such sections serve as braking mandrels, the path along which the braking wing 11 or the section 5'*a* of the braking bar 5' must move during the pulling in is elevated by means of a path extender 14'. The path extender 14' is designed in the present exemplary embodiment as a kind of a hump or projection which, in its simplest form, is a bent-up portion of the material of the base plate 2'. To avoid jammings, the path extender 14' is rounded in its transition areas so that the shape of the hump, in a side view, corresponds approximately with the positive half of a sine curve. From this results a particularly resistance-free guide for the braking bar 5' which, during a stepping down on the operating pedal 4, slides by means of its section 5'c over the hump of the extender 14'. In order to permit this movement, the bearing plate 6'a is urged downwardly at each of its two holding bolts 12a and 12b by means of a compression spring 13 encircling the bolts 12a and 12b. The two springs 13 permit a lifting of the bearing plate 6' when the two sections 5'c of the braking bar 5' slide over the hump of the extender 14'. The path of the section 5'c of the braking bar 5' over the hump 14' and the path of the bolt 12b in the slot 6'c of the bearing plate 6' are designed so that the path on the hump 14' corresponds substantially with the angled section 6'$c_2$ of the slot 6'c. Through this, it is assured that the free end of the braking wing 11, or of the section 5'a of the braking bar 5' when such section 5'a acts as a braking mandrel, can never get caught on the side edge of the ski 1, whether we speak of a swivelling of the ski brake 10' from the braking into the retracted position or vice versa.

In other words, as the braking bar 5' moves from the braking to the retracted position, the sections 5'c and bearing plates 6' slide along the ski 1 away from the axle 7. As this happens, the bolts 12a and 12b slide in the slots 6'b and 6'c. The bolt 12b begins at the end of the rectilinear slot portion 6'$c_1$ remote from the bend 6'd and slides toward the bend 6'd. The bolt 12b reaches the bend 6'd at approximately the same time the section 5'c reaches the extender 14' and before the section 5'g reaches the base plate 2'. As the section 5'c passes over the hump of the extender 14', the bearing plate 6' is lifted against the force of the springs 13 and the sections 5'a are raised above the surface of the ski 1, as shown in broken lines at 30 in FIG. 3, and are subsequently lowered to a position closer to the surface of the ski, as shown at 31. Simultaneously, the bolt 12b enters the slot portion 6'$c_2$ and slides away from the bend 6'd, causing the bearing plate 6' to pivot inwardly about the bolt 12a, which in turn causes the bearing 6'a to shift the position of the braking arm section 6'c so that the braking mandrel 11 is pulled laterally inwardly over the surface 1a of the ski 1 to the position shown in FIG. 4.

Figure 4A:
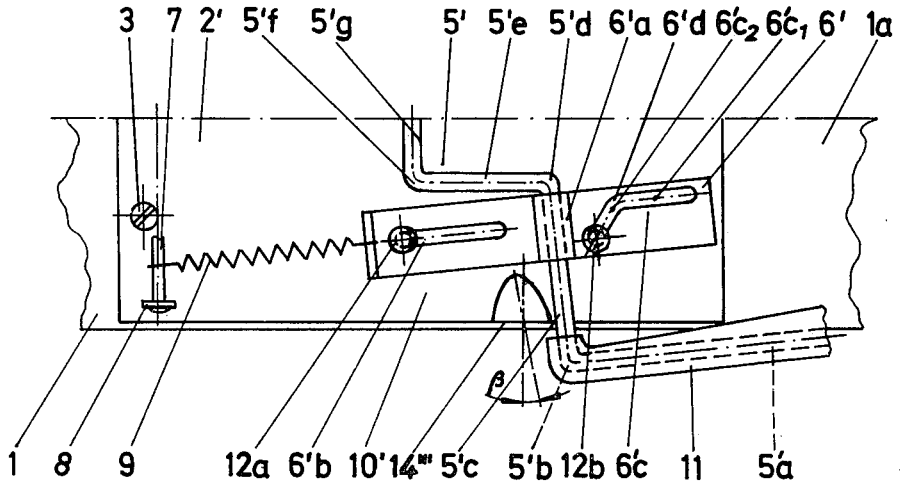
FIGS. 4*a* and 4*b* show a variation of the path extender of the embodiment of FIGS. 3 and 4.
Figure 4B:
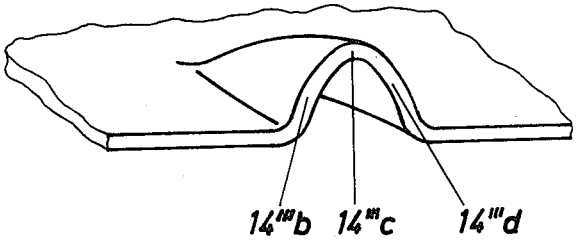

It can easily be understood that the degree of upward movement of the bearing plate 6' may be different in the area which is adjacent the swivel axle 7 of the operating pedal 4 than in the area which is remote from such swivel axle. For this reason, if needed, the force of the respective pressure springs 13 which are provided on the two holding bolts 12 may be dimensioned differently. Furthermore, the path extender 14' does not have to extend substantially parallel with respect to the longitudinal axis of the ski. Preferably one can choose here a design which corresponds to a kind of a saddle surface. This saddle surface has then a center line which preferably defines a solid angle with the plane which extends at a right angle to the longitudinal axis of the ski 1 and is positioned vertically on the upper side 1a of the ski 1. If necessary, the angle can refer either to the horizontal or to the vertical plane. FIGS. 4a and 4b show in detail a path extender 14''' which is formed similar to a saddle surface. The center line of the saddle surface 14''' defines an acute angle $\beta$ with the plane which extends at a right angle with respect to the longitudinal axis of the ski 1 and is positioned vertically on the upper side 1a of the ski 1, as shown in FIG. 4a.

Figure 3:
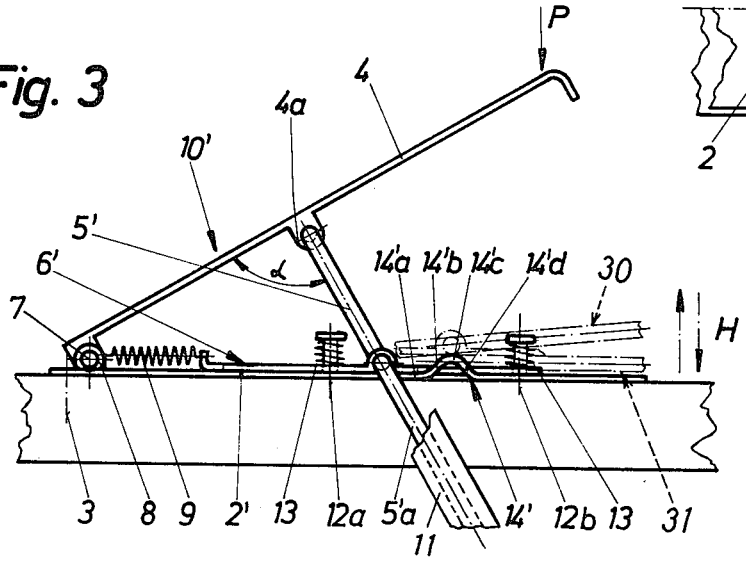

It is self-explanatory that a movement of the braking bar 5' from the position shown in FIG. 3 to the a position similar shown in to FIG. 4 causes the second section 5'c of the braking bar 5' to move along the ascending part 14'''b of the saddle surface 14''' and, having passed the highest point 14''' of this, to move along the decending part 14'''d of the saddle surface 14'''. Therefore the movement of the section 5'a of the braking bar 5' is similar to that which has been described in association with the embodiment shown in FIGS. 3 and 4.

Through this, a particularly favorable controlled guide for the second section 5'c and thus for the entire braking bar 5' is achieved. Such a guide is particularly favorable in view of avoiding possible wobbling effects, since a braking bar which is pivotally supported at two axes generally has a tendency to wobble.

Figure 2:
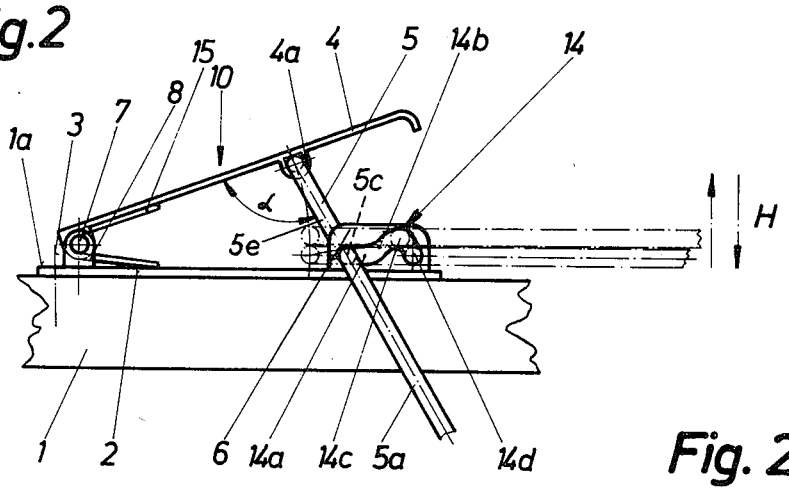
FIG. 2 is a side view of a first exemplary embodiment of the inventive ski brake in the braking position.

In the first exemplary embodiment, according to FIG. 2, holding parts 6 are provided on the base plate 2 and are preferably designed as upwardly bent plates which are portions of the material of the base plate 2 and extend parallel to the longitudinal axis of the ski. A path extender 14 is provided as a guideway or guide slot in each of the two plates 6 which has a substantially rectilinearly extending first section 14a, a rounded portion connecting the section 14a to a rising section 14b, a culmination point 14c and a falling section 14d. It can easily be understood that the path extender 14 which is constructed as a guide slot corresponds functionally and operationally to the previously and thoroughly described path extender 14'. To achieve here also a significant pulling-in effect, the plate 6, in contrast to the illustration according to FIG. 2, can be arranged at an acute angle with respect to the longitudinal axis of the ski 1. This is illustrated in FIG. 2a which, but for the angling of the plates 6, is to be considered identical to FIG. 2.

Figure 2A:
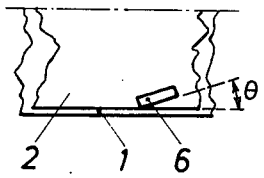
FIG. 2*a* is a top view of a modification of the embodiment according to FIG. 2, which improves the pulling-in operation with the operating pedal and braking bar omitted for clarity.

In other words, the embodiment of FIG. 2a is identical to the embodiment of FIG. 2, except that the plates 6 are arranged at an angle $\theta$ (FIG. 2a) with respect to the longitudinal axis of the ski, whereas the plates 6 in the embodiment of FIG. 2 are substantially parallel to the longitudinal axis of the ski. For clarity, the operating pedal and braking bar have been omitted from FIG. 2a. As the holding arm sections 5c of the braking bar 5 slide rightwardly in the slots in the plates 6, the angled plates 6 (FIG. 2a) cooperate with the lower ends of the sections 5e of the braking arms 5 and urge them toward each other, so that a significant pulling-in of the braking mandrels 5a results.

The embodiment in FIG. 5 has a frame 6'' within which the braking bar 5'' is guided movably by means of its sections 5''c. A path extender 14'' is a hump which is a bent-up portion of the material of the base plate 2''. To achieve the pulling in of the braking wing 11, or the first section 5''a of the braking bar 5'' when such section is designed as a braking mandrel, the hump 14'' can be designed similar to the hump already described in connection with the first exemplary embodiment according to FIGS. 3 and 4. The frame 6'' may extend parallel to the longitudinal axis of the ski or may be angled in a manner similar to the plate 6 in FIG. 2a.

The invention is not limited to the described exemplary embodiments. Modifications can be carried out without leaving the scope of the claims. For example, the path extender can be manufactured as a separate structural part and may consist of a different material than the base plate or the braking bar. In particular, plastics which have a small frictional resistance are suited for use as path extenders. Alternatively, it is possible to provide only the contact surface of the path extender with a plastic coating. Also, the sliding areas of the second sections of the braking bar can be coated with a material which has good sliding characteristics.

A different modification may consist in using as an erecting spring a separate torsion or leg spring which directly biases the operating pedal. Through this, it is possible to replace the self-torsion of the braking bar, which torsion is typically used for erecting the ski brakes of the first and third exemplary embodiments of FIGS. 2 and 5, partly or totally with the force of the separate erecting spring. As shown in FIG. 2, for example, a leg spring 15 could be provided which encircles the axle 7, has one torsion disposed on the base plate 2, and has its other leg disposed on the pedal 4. Also, in the second exemplary embodiment of FIGS. 3 and 4, it would through this be possible to reduce the forces of the tension springs 9 which bias the two bearing plates.

It also lies within the scope of the invention to combine the measures of the individual exemplary embodiments, where technically conceivable and possible.

Furthermore, the sequence of movement of the tip of the braking wing 11 can also take place as is indicated in the right half of FIG. 1 at 34 with a thin dash-dotted line.

The embodiments of the invention in which an exclusive property or privilege is claimed are defined as follows:

1. A ski brake adapted to be mounted on a ski, comprising a base plate, an operating pedal supported on said base plate for pivotal movement about a first axis, two bearing plates having first and second slots therein supported above and generally parallel to said base plate for movement relative thereto in directions generally longitudinal of the ski between first and second positions, said bearing plates being closer to said first axis in said first position than in said second position, four upright holding bolts secured to said base plate and slidably received in respective said slots in said bearing plates, a spring yieldably urging each said bearing plate toward said first axis, a braking bar which is made of a bent wire material, has two braking mandrels, has two sections which are respectively supported on said bearing plates for pivotal movement about a second axis, and is pivotally supported on said operating pedal at a location remote from said first and second axes, and an upward projection provided on said base plate which engages said braking bar as said bearing plates move between said first and second positions and has rising and falling sections which cause said sections of said braking bar to move upwardly and then downwardly during movement thereof longitudinally of said ski with said bearing plates, each said first slot in said bearing plates being generally rectilinear and extending generally longitudinally of the ski, and each said second slot being bent and, viewed in said first position of said bearing plates, having a rectilinear first section which extends substantially parallel to the longitudinal axis of the ski and, at the end thereof nearest said first axis, has a bend connecting it to a second section which defines an acute angle with respect to the longitudinal axis of the ski, wherein said bend of said bent second slot is positioned to cooperate with said holding bolt slidably receiving therein when, viewed with said bearing plates in said second position, said section of said braking bar is engaging a rising section of said projection, and wherein the length of said second section of said bent second slot is at least as long as the longitudinal distance which said section of said braking bar travels as it moves over said projection.

2. A ski brake adapted to be mounted on a ski, comprising a braking bar which has at least one braking mandrel and means defining a horizontal axle extending transversely of the ski, guide means supporting said braking bar for pivotal movement about said axle between a braking and a retracted position and supporting said axle for movement in directions generally longitudinal of the ski between first and second positions, and said guide means further including means for effecting upward and then downward movement of said axle during movement thereof between said first and second positions, and operating means cooperable with said braking bar for simultaneously effecting pivotal movement thereof between said retracted and braking positions and movement of said axle between said first and second positions, said axle being in said first position when said braking bar is in said braking position, said operating means further including resilient means yieldably urging said braking bar toward said braking position and said axle toward said first position, said braking mandrel projecting below a bottom surface of the ski when said braking bar is in said braking position and being above a top surface of the ski when said braking bar is in said retracted position.

3. The ski brake of claim 2, including a base plate, and wherein said operating means includes an operating pedal supported on said base plate for pivotal movement about a substantially horizontal first axis extending parallel to said axle, said braking bar being supported on said operating pedal for pivotal movement about a second axis spaced from and parallel to said first axis and said axle, said axle being closer to said first axis in said first position than in said second position.

4. The ski brake of claim 3, wherein said braking bar has two braking mandrels, and said axle is defined by two laterally spaced sections of said braking bar which are generally horizontal and extend generally transversely of the ski.

5. The ski brake of claim 4, wherein said guide means includes two laterally spaced, upright plates fixed to said base plate, each said plate having therein an elongated slot in which said axle is slidably received, each slot including a straight portion in the region of said first position of said axle which is followed by a rising portion and then a falling portion in the region of said second position of said axle, said rising and falling portions of said slots effecting said upward and downward movement of said axle.

6. The ski brake of claim 5, wherein said rising and falling portions of said slots have the shape of the positive half of a sine curve.

7. The ski brake of claim 5, wherein said upright plates are each arranged at an acute angle with respect to the longitudinal axis of the ski.

8. The ski brake of claim 5, including a torsion spring cooperable with said base plate and operating pedal which urges pivotal movement of said operating pedal about said first axis.

9. The ski brake of claim 4, wherein said guide means includes two bearing plates which each have a respective said section of said braking bar pivotally supported thereon and have first and second slots therein, two pairs of upright, longitudinally spaced holding bolts which are each secured to said base plate and slidably received in a respective said slot in a respective said bearing plate, said first slot in each said bearing plate being substantially rectilinear and extending generally parallel to the longitudinal axis of the ski, and said second slot having a first rectilinear section which extends generally parallel to said first slot and a further rectilinear section which communicates at one end with an end of said first rectilinear section and is arranged at an acute angle with respect thereto, means for yieldably urging said bearing plates downwardly relative to said holding bolts, and means defining a rounded, upward projection on said base plate positioned for engagement with said sections of said braking bar during movement thereof to effect said upward and downward movement thereof.

10. The ski brake of claim 9, wherein said upward projection is an upwardly bent portion of said base plate and has the shape of the positive half of a sine curve, wherein said means for urging said bearing plates downwardly includes a respective helical spring encircling each said holding bolt above the bearing plate, and wherein said resilient means includes two helical expansion springs which each have one end fixed against movement relative to said base plate in the region of said first axis and the other end supported on a respective said bearing plate, whereby said bearing plates are yieldably urged toward said first axis.

11. The ski brake of claim 4, wherein said guide means includes means on said base plate defining two elongated, longitudinally extending, laterally spaced frames, said sections of said braking bar each extending through a respective said frame, and includes a rounded upward projection on said base plate within each said frame and engageable with said sections of said braking bar during movement thereof within said frame for effecting said upward and downward movement thereof.

12. The ski brake of claim 4, including means for reducing friction between said guide means and said sections of said braking bar.

13. The ski brake of claim 4, wherein said braking bar is made of a bent wire material.

* * * * *